US006398188B1

(12) United States Patent
Salman

(10) Patent No.: US 6,398,188 B1
(45) Date of Patent: Jun. 4, 2002

(54) POST PULLER

(76) Inventor: Mark T. Salman, 1710 Harrod La., Greensboro, NC (US) 27410

( * ) Notice: Subject to any disclaimer, the term of this patent is extended or adjusted under 35 U.S.C. 154(b) by 7 days.

(21) Appl. No.: 09/725,891

(22) Filed: Nov. 30, 2000

(51) Int. Cl.[7] ..... E21B 19/00
(52) U.S. Cl. ..... 254/30
(58) Field of Search ..... 254/29–31, 132, 254/89 H, 93 H, 93 R

(56) References Cited

U.S. PATENT DOCUMENTS

| | | | | | |
|---|---|---|---|---|---|
| 2,952,131 | A | * | 9/1960 | Lyroudias | 254/30 |
| 3,358,967 | A | * | 12/1967 | Harmon | 254/30 |
| 3,526,387 | A | | 9/1970 | Fleming | |
| 3,647,185 | A | * | 3/1972 | Phibbs | 254/30 |
| 4,244,560 | A | | 1/1981 | Hawkins | |
| 4,327,534 | A | * | 5/1982 | Mastalski et al. | 254/30 |
| 4,422,621 | A | | 12/1983 | Ekern | |
| 4,706,935 | A | | 11/1987 | Thompson | |
| 4,746,096 | A | | 5/1988 | Donnell et al. | |
| 5,011,117 | A | | 4/1991 | Youngblood et al. | |
| 5,368,277 | A | | 11/1994 | Moss | |
| 5,492,437 | A | | 2/1996 | Ortiz | |
| D372,177 | S | | 7/1996 | Hansen | |

* cited by examiner

*Primary Examiner*—Robert C. Watson
(74) *Attorney, Agent, or Firm*—Richard C. Litman

(57) ABSTRACT

The post puller has an H-shaped base including a pair of parallel legs and a crossbeam normal to the legs, the crossbeam being offset from the midpoint of the legs and defining a shallow channel and a deep channel. A pair of rectangular blocks attached to the legs and crossbeam in the deep channel provide platforms on which a pair of single action hydraulic cylinders are mounted, and define a recess which straddles the post to be pulled. A cross member is pivotally mounted to each cylinder rod. A chain is suspended from the midpoint of the cross member. The chain may be wrapped directly around the post, or a post gripping structure may be attached to the free end of the chain. A pair of wheels may be mounted to the base for portability.

20 Claims, 5 Drawing Sheets

POST PULLER

BACKGROUND OF THE INVENTION

1. Field of the Invention

The present invention relates to a post puller for pulling a post or a post anchor from the ground.

2. Description of the Related Art

Several devices are supported by one or more posts driven into the ground. Such devices include signs, mail boxes, fences, and the like. The post may be a one-piece post with the load carrying portion driven directly into the ground, or a two piece post with a post anchor driven into the ground, and the upper or load carrying portion of the post being driven or bolted to the post anchor. For purposes of the present application, the term "post" will be used to refer to either the one-piece or two piece assembly, and to either a post or post anchor. From time to time it may become necessary to remove or relocate the post. It then becomes necessary to remove the post and/or the post anchor.

It is sometimes possible to remove the post manually. This process is labor intensive, and may require striking the post from several different directions with a sledge hammer to loosen the ground about the post, and then leaning over and grabbing the post and yanking the post out of the ground. Not only is the process labor intensive, but the post may become damaged so that it cannot be reused, and the laborer can sustain a back injury in the process.

In order to obviate these problems, several machines or mechanical devices have been developed. U.S. Design Pat. No. 372,177, issued Jul. 30, 1996 to S.C. Hansen, shows a mechanical post puller with a single support post having a roller offset from the top of the post and what appears to be a ratchet mechanism with a C-shaped arm for gripping a post at the bottom of the support post.

Several devices are adapted for use with a tractor, front end loader, or other vehicle with a hydraulic system. U.S. Pat. No. 3,526,387, issued Sep. 1, 1970 to H. B. Fleming, describes a post puller having a metal plate base with a flared opening for straddling a post, a pair of uprights pivotally mounted on opposites side of the flared opening, a single hydraulic cylinder, pivotally mounted to the base and connected to a vehicle hydraulic system, a lever arm connected between the cylinder ram and the two uprights, and a chain with a post gripping fixture depending from the lever arm. U.S. Pat. No. 4,244,560, issued Jan. 13, 1981 to W. H. Hawkins, discloses a tree puller attached to a front end loader with a bifurcated wedging member for cutting into a tree trunk, a pair of parallel ground engaging members, each having a hydraulic cylinder mounted thereon with the cylinder rods being attached to an elevatable frame, the wedging member also be attached to the elevatable frame, so that the wedging member cuts into a tree trunk and the cylinder rods are extended to lift the tree out of the ground. U.S. Pat. No. 4,706,935, issued Nov. 17, 1987 to G. L. Thompson, teaches a post puller attached to a tractor three-point hitch, the puller including a stationary gripping plate and a pivotally mounted arcuate gripper, both grippers having teeth for clamping and gripping a post or tree therebetween.

Still other patents are primary concerned with the problem of post slippage in the post puller, several such patents dealing with T-shaped fence posts. U.S. Pat. No. 4,422,621, issued Dec. 27, 1983 to P. B. Ekern, shows a puller for pulling ranch fence posts having lugs extending from the flange of a T-shaped post, the puller having a pair of plated connected by a cross member, the plates having a slot defined therein for receiving a pin which lodges against a fence post lug. A chain is attached to the plates and the post is pulled by a hydraulic cylinder or jack. U.S. Pat. No. 5,011,117, issued Apr. 30, 1991 to Youngblood et al., describes a post puller having a plate with a hole in it so that the plate fits around the post. A chain pulls one side of the plate so that the plate tilts and grips the side of the post to pull it out.

U.S. Pat. No. 5,368,277, issued Nov. 29, 1994 to F. Moss, discloses a device for pulling a T-shaped fence post having bracket and a clevis which fits over the post and is pivotally attached to the bracket. A ring is placed through the bracket and a chain is looped through the ring. A lever is placed through the chain and braced against the ground to pull the post.

A more remote device having some features in common with the present invention is an apparatus for driving a pipe or other: elongated member horizontally through the ground, as described in U.S. Pat. No. 4,746,096, issued May 24, 1988 to Donnell et al. The apparatus uses a rectangular frame with a pair of parallel hydraulic cylinders having rods attached to a tray by a cradle bar. The tray has a plurality of pairs of spaced apart gussets which support a moveable end plate which is placed at an end of a pipe to be driven horizontally into the ground, the pipe being disposed between the hydraulic cylinders. The cylinders are extended to move the tray and pull the end plate against the pipe for the stroke distance of the rods, the end plate is moved forward in the tray, and the process is repeated to drive the pipe into the ground in stages. Optionally, jaws may be attached to the tray for gripping the pipe below collars placed on the pipe to pull the pipe out as the cylinder rods retract.

Another device for a dissimilar purpose but having some features in common with the present invention is a device for lifting the foundation of dwellings, buildings and other structures, described in U.S. Pat. No. 5,492,437, issued Feb. 20, 1996 to L. P. Ortiz. The device has a pier guide tube attached to a support plate which fits under a foundation footing and has two parallel hydraulic cylinders pivotally attached to the guide tube. The cylinder rams are pivotally attached to an articulating bar having a pier compression means between the two rams. A pier is placed into the guide tube and connected to the compression means. One or more piers are driven into the ground until they reach bedrock, after which further retraction of the rams raises the structure. The pier is then permanently affixed to the foundation and the hydraulic cylinders are detached.

There are several problems associated with the post pullers known in the art. Several of the devices are expensive or heavy devices which require attachment to a vehicle for operation. Many manual pullers require that the operator complete the operation in a bent position to extract the post, resulting in back strain and related back injuries. Many puller devices apply a load from the side of the post or utilize a pulling force with a large lateral component relative to the axis of the post, making the post difficult to extract. Consequently there is a need for a lightweight, portable, relatively inexpensive post puller which applies a pulling force primarily along the axis of the post.

None of the above inventions and patents, taken either singularly or in combination, is seen to describe the instant invention as claimed. Thus a post puller solving the aforementioned problems is desired.

SUMMARY OF THE INVENTION

The post puller has an H-shaped base including a pair of parallel legs and a crossbeam normal to the legs, the crossbeam being offset from the midpoint of the legs and defining a shallow channel and a deep channel. A pair of rectangular blocks attached to the legs and crossbeam in the deep channel provide platforms on which a pair of single action hydraulic cylinders are mounted, and define a recess which straddles the post to be pulled. A cross member is pivotally mounted to each cylinder rod. A chain is suspended from the midpoint of the cross member. The chain may be wrapped directly around the post, or a post gripping structure may be attached to the free end of the chain. A pair of wheels may be mounted to the base for portability.

The base assembly is preferably made from aluminum. The entire post puller assembly is lightweight, permitting the post puller to be easily transported on the optional wheels by hand, without the need for a vehicle to transport the puller. The post puller is a self-contained unit, and does not require attachment to a vehicle hydraulic system. In use, each cylinder may be raised individually to rock the post enough to loosen the ground surrounding the post, and then the cylinders may be raised simultaneously to pull the post straight up from the ground. Therefore the unit is more efficient, directing the pulling force along the axis of the post during final extraction of the post.

Accordingly, it is a principal object of the invention to provide a portable post puller for pulling sign posts, mail box posts, fence posts, and the like.

It is another object of the invention to provide a post puller capable of exerting a pulling force directly on the axis of the post.

It is a further object of the invention to provide a post puller with a pair of hydraulic cylinders which may be operated, independently in order to pull a post vertically even on sloping ground.

Still another object of the invention is to provide a post puller with a cross member which may pivot on either side of the post in order to loosen the post before pulling the post vertically from the ground.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
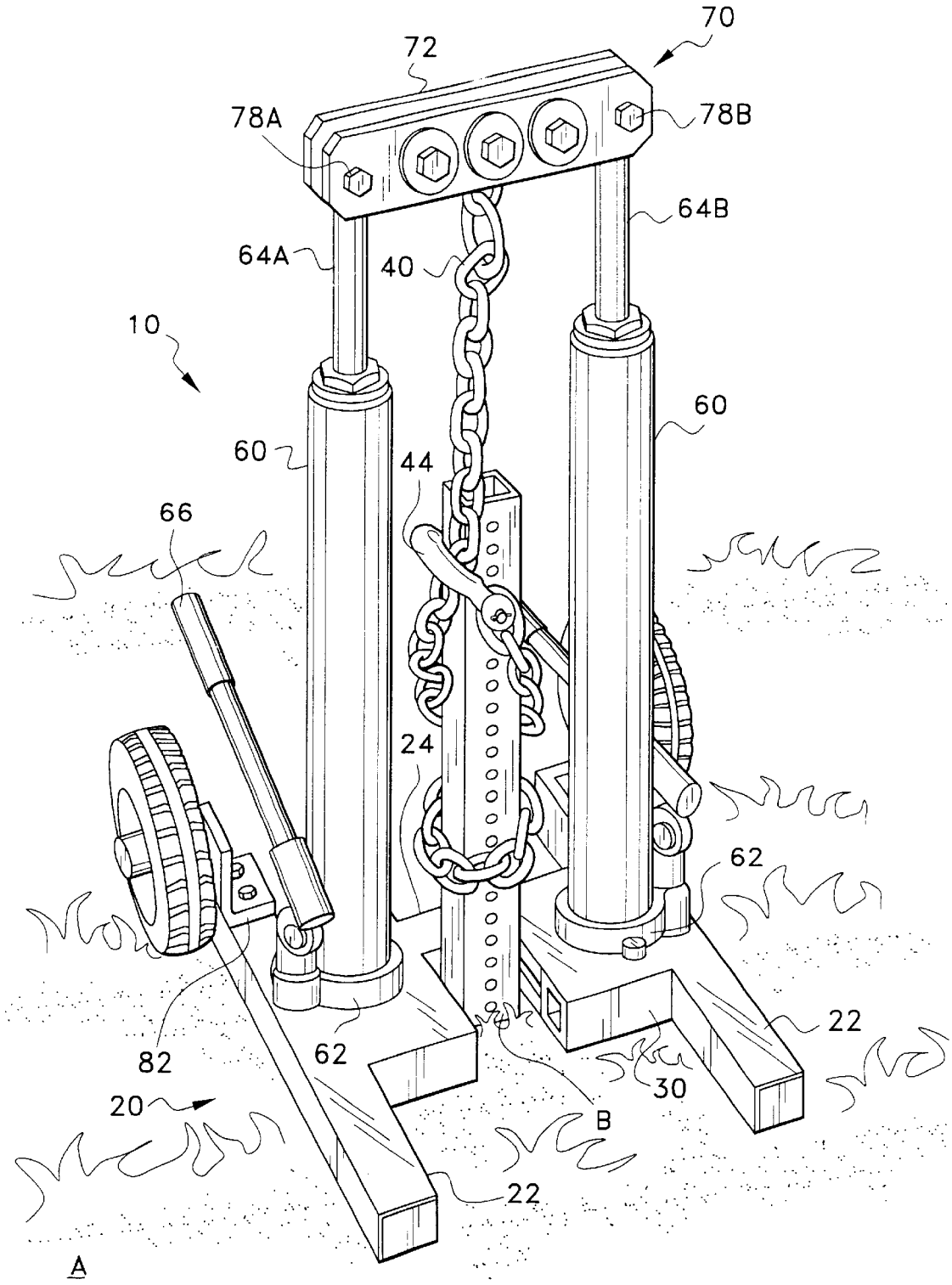
FIG. 1 is an environmental, perspective view of a post puller according to the present invention.
Figure 2:
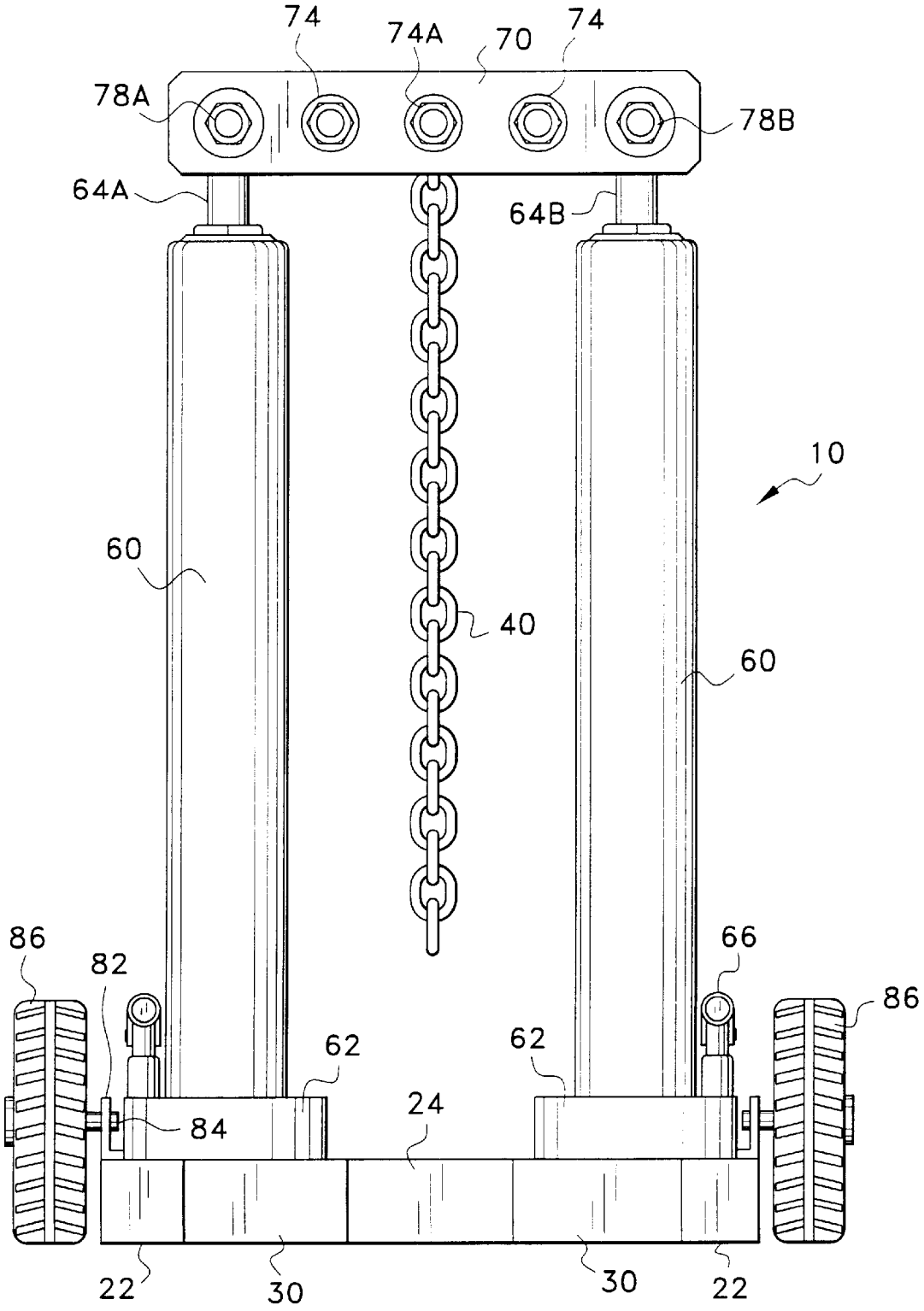
FIG. 2 is a front view of a post puller according to the present invention.

The present invention is a post puller, referenced generally as 10 in the drawings, for pulling posts and post anchors from the ground. As shown in FIG. 1, the post puller 10 is transported to the post site, the base 20 is seated on the ground A with the legs 22 of the base 20 straddling the post B, the hoist chain 40 is suspended directly above the post B, the free end of the chain 40 is attached to the post B, and the post B is pulled from the ground by operation of a pair of hydraulic cylinders 60.

As shown in FIGS. 1–4, the post puller 10 has a base 20 which includes a pair of parallel legs 22 joined by a crossbeam 24 normal to the legs 22 defining a generally H-shaped base 20. As seen most clearly in FIG. 3, the crossbeam 24 does not bisect the legs, but is offset towards the rear of the base 20 to define a deep channel 26 at the front of the base 20 and a shallow channel 28 at the rears of the base 20. A pair of flat, box shaped platforms 30 are attached to the base 20 at the junction of the legs 22 and the crossbeam 24 on opposite sides of the deep channel 26 and define a recess 32. The legs 22 and crossbeam 24 may be made from square tubing which is joined by welding, but in a preferred embodiment is made in one piece by casting, forging, molding, or by other metal forming processes. In a preferred embodiment, the base 20 is made from a lightweight aluminum alloy, such as 356-T6.

The puller 10 has a pair of single action hydraulic cylinders 60 mounted on the platforms 30 so that the two cylinders 60 are disposed on opposite sides of the recess 32. Each cylinder 60 has a base 62 which is fixedly attached to a platform 30 so that the, cylinder 60 does not pivot about its mounting point, an extensible rod 64A and 64B, respectively, with a piston (not shown) slidably disposed within the cylinder 60, and a pump handle 66 for pumping hydraulic fluid through a one-way valve (not shown). The rods 64A and 64B are retracted by releasing the one-way valve. The internal construction of the cylinders 60 is conventional and well known, and will not be further described herein. It will be noted that each hydraulic cylinder 60 is a self-contained unit, requires no connection to an external hydraulic system, and that each hydraulic cylinder 60 is independently operated and actuated by its pump handle 66.

The free end of each rod 64A and 64B is pivotally attached to opposite ends of a cross member 70 by bolts 78A and 78B, respectively, or other type of pivot pin. Cross member 70 is formed by a pair of parallel plates 72 maintained in spaced apart relation by at least one, and preferably a plurality of, bolts 74 which extend through spacer sleeves 76, including a center bolt 74A which bisects the distance between the end bolts 78A and 78B and the free ends of rods 64A and 64B. Cross member 70 is positioned so that center bolt 74A is disposed directly above the center of recess 32 when the base 20 is resting on a horizontal surface.

Figure 3:
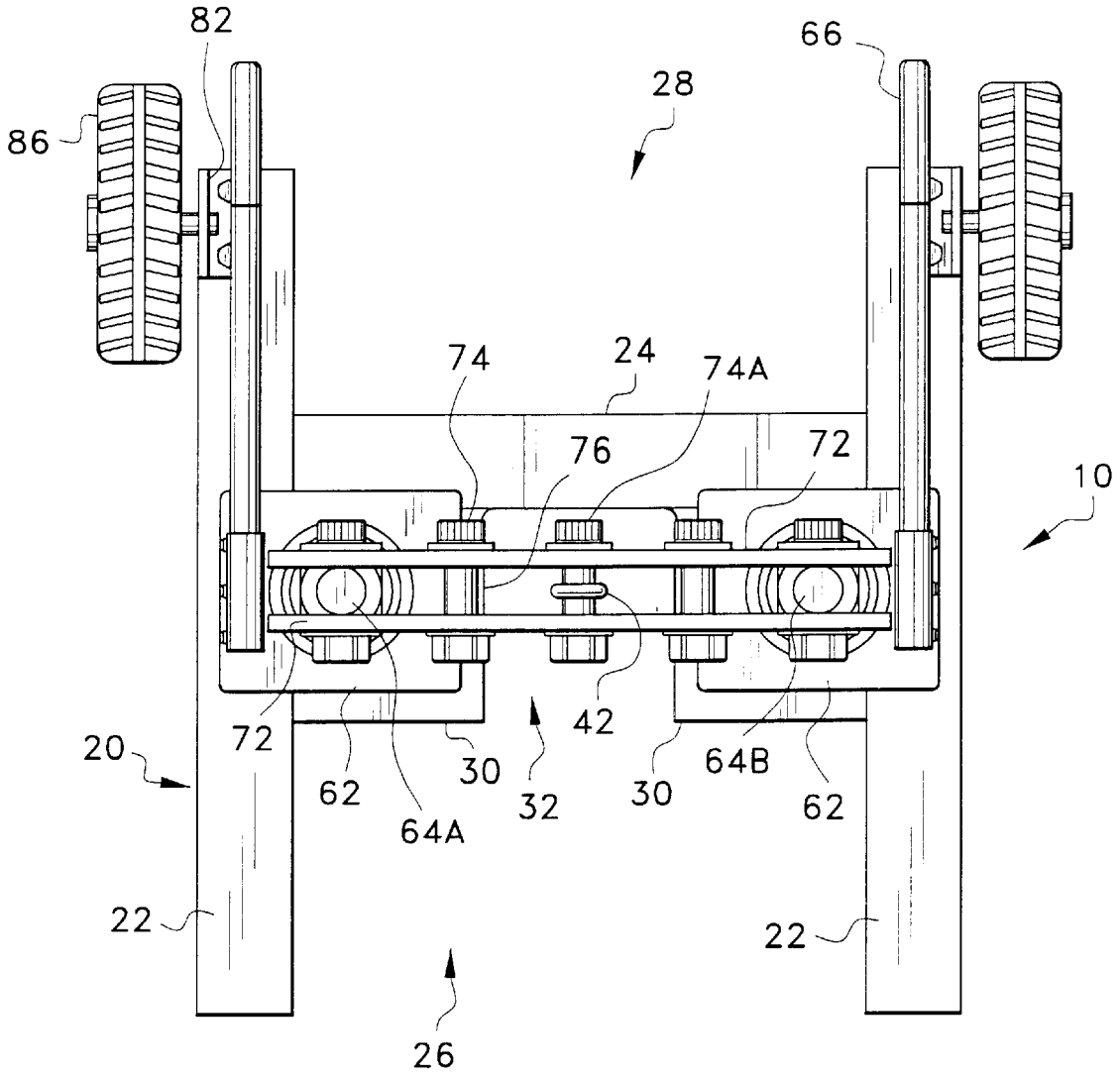
FIG. 3 is a plan view of a post puller according to the: present invention.
Figure 4:
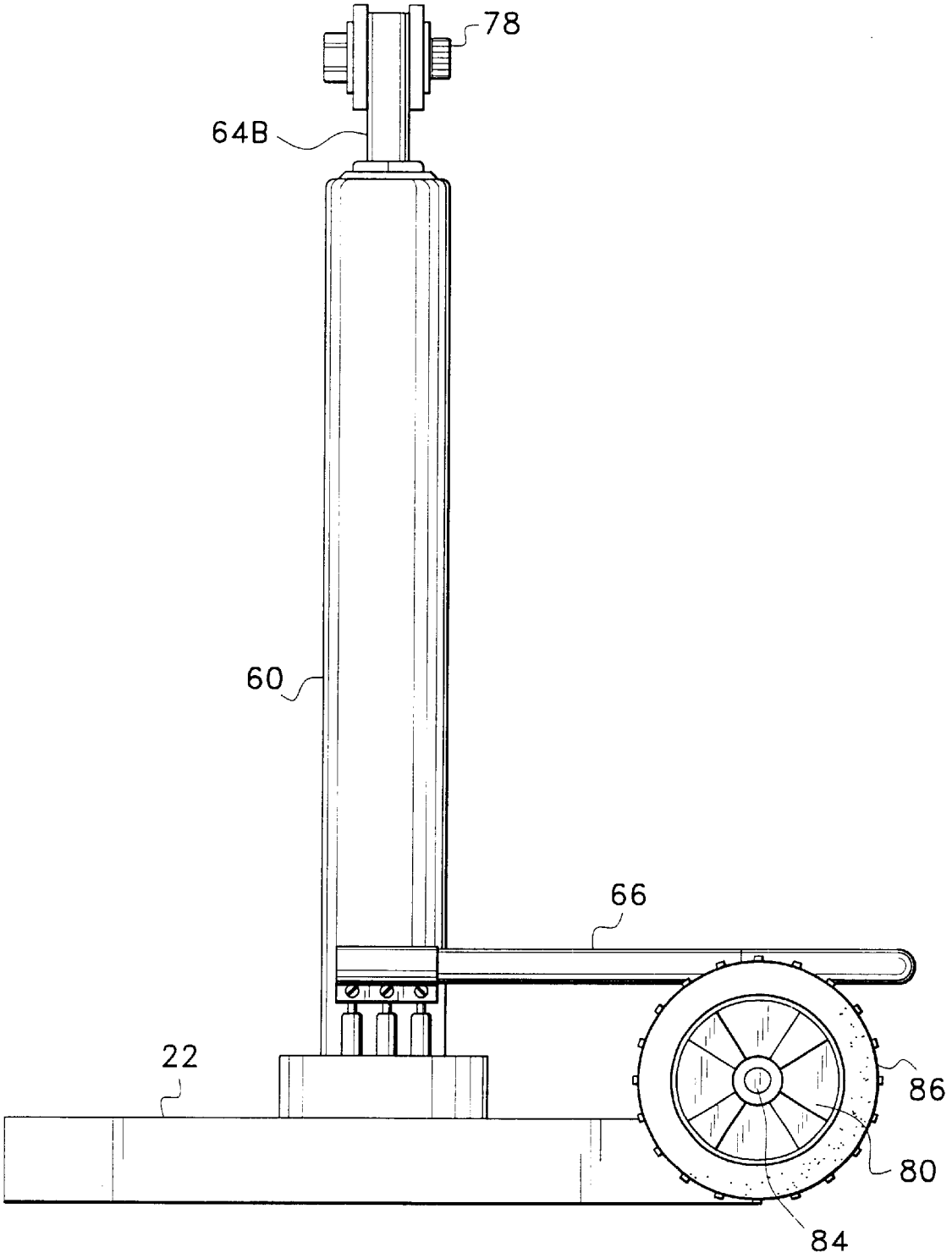
FIG. 4 is a side view of a post puller according to the present invention.

Hoist chain 40 is attached to the center bolt 74A so that chain 40 is aligned with recess 32. Chain 40 may be attached to center bolt 74A by any appropriate means, as by a hook, by extending center bolt 74A through a link 42 in the chain 40 as shown in FIG. 3, or by other conventional means. The free end of the chain 40 is attached to a post B by any conventional means. Such means may include wrapping the chain 40 around the post B with overlapping loops, attaching a clamp, such as horseshoe clamp 44, to the end of the chain 40 for gripping the sides of the post B, a hook 46 (seen in FIG. 5) which may be inserted through a mounting aperture in the post B, a gripper or clamp (not shown) which may be attached to the post B by extending a bolt through the post and one or more links in the chain 40, etc.

Optionally, the puller 10 may include a pair of wheels 80 mounted to the base 20 for transporting the puller 10. The wheels 80 may be attached to the base 20 by bolting a pair of mounting brackets 82, which may have an angle iron shape formed by two flanges defining a right angle, to the rear of legs 22, and mounting axles 84 to the upstanding flange of brackets 82 so that the axles 84 extend outboard from base 20. Wheels 80 are rotatably mounted on axles 84 and may include pneumatic tires 86 mounted about their rims. The diameter of wheels 80 are sized and dimensioned so that the external perimeter of tires 86 are raised above the ground by between about ½" to when the base 20 is flush against the ground A. In order to transport the puller 10, the cross member 70 is grasped and the puller 10 is tilted rearward until the tires 86 contact the ground A and the weight of the puller 10 is balanced so that the puller may be wheeled about after the fashion of a two-wheeled cart or dolly.

In use, the puller 10 is positioned with the base 20 flush against the ground A with the post B disposed in recess 32. The chain 40 is attached to the post B by any appropriate attachment or post gripping means. Initially the operator pumps the handle 66 of the cylinder 60 on one side of the puller 10 to raise the rod 64A, the rod 64B on the other side remaining stationary while the cross member 70 pivots about its end bolt 78B. Then the operator pumps the handle 66 of the cylinder 60 on the opposite side to raise the rod 64B while rod 64A remains stationary, the cross member 70 pivoting about end bolt 78B. The platforms 30 on opposite sides of recess 32 act as a guide, preventing the puller 10 from moving or walking during the pulling process. The operator may repeat the process of alternately pumping first one cylinder and then the other to rock the post B to loosen the surrounding soil, the cross member 70 acting as a second class lever alternately pivoting about one fulcrum 78B and then the other 78A. Finally the operator pumps both handles 66 simultaneously to exert maximum pulling force directly along the axis of the post B, without a net lateral component which might shift the post B to one side or the other, until the post B is extracted from the ground A.

Figure 5:
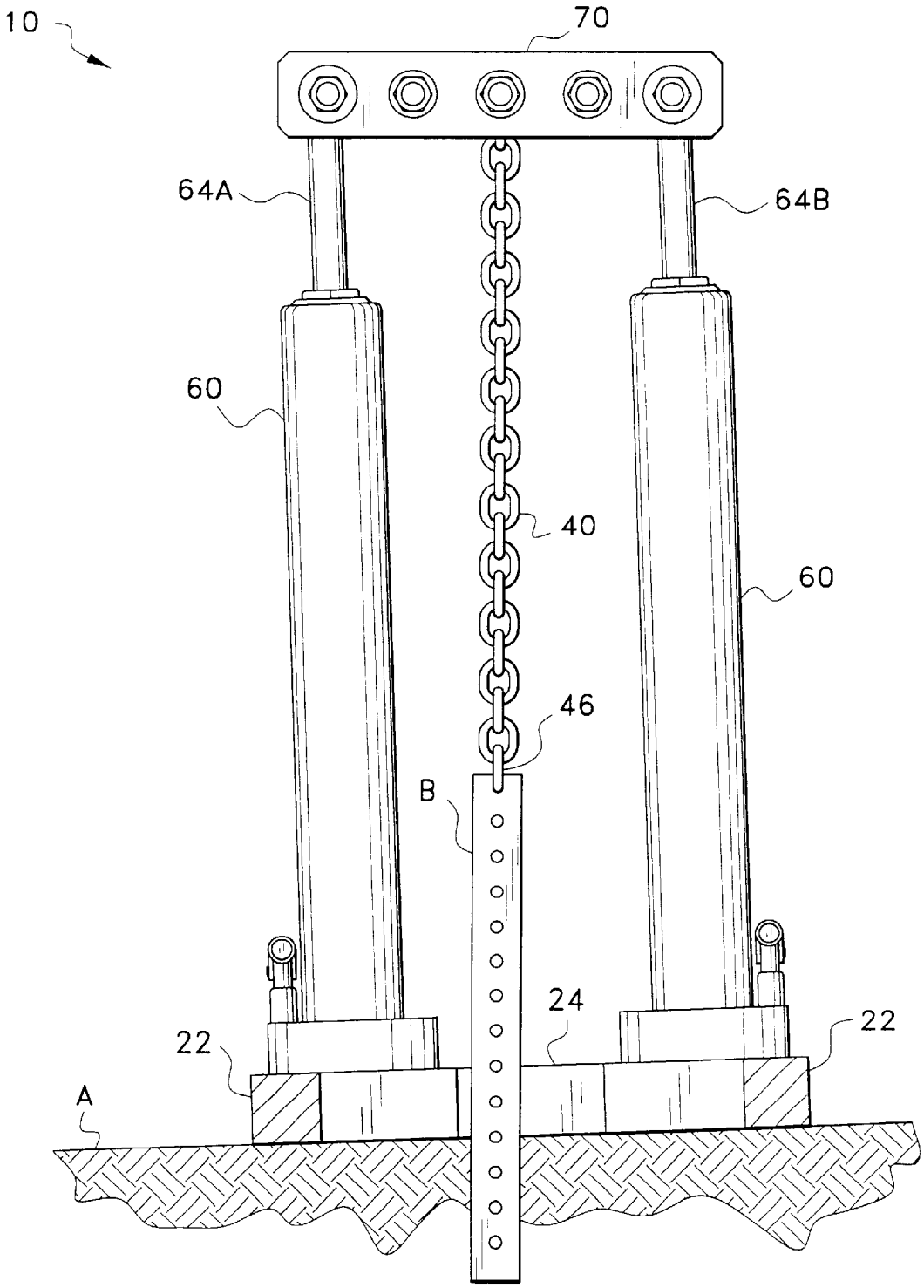
FIG. 5 is an environmental view of a post puller according to the present invention removing a post from sloping ground, the wheels being omitted.

FIG. 5 illustrates use of the post puller 10 to remove a post B from sloping ground A. Since the cylinders 60 may be operated independently, the rod 64A on the lower side may be extended a greater distance than the rod 64B on the higher side until the, cross member 70 is level, and then both rods 64A and 64B may bet extended simultaneously to raise the post B vertically on sloping ground.

The puller 10 has a wide base 20 with elongated legs 22 in order to distribute the pulling force over a wide area of the ground A while exerting a large pulling force on the post B, as compared to pullers which exert a pulling force only from one side of the post. By applying parallel and equal pulling forces from opposite sides of the post B, a greater pulling force may be applied for easier extraction of the post B. Advantageously, the mechanical advantage applied by the employment of parallel hydraulic cylinders 60 to extract posts from the ground reduces the likelihood of back strain and related ailments incurred during post pulling operations.

It is to be understood that the present invention is not limited to the embodiments described above, but encompasses any and all embodiments within the scope of the following claims.

I claim:

1. A post puller for pulling a ground-mounted post, comprising:

a) a base having a first leg and a second leg in parallel, spaced apart relation for engaging the ground on opposite sides of the post;

b) a first hydraulic cylinder and a second hydraulic cylinder attached to said base, each of the cylinders being an independently operable unit having a cylinder base, an extensible rod having an end slidable in the cylinder and a free end, and a pump handle attached to the cylinder base;

c) a cross member having a first end pivotally attached to the free end of said first rod and a second end pivotally attached to the free end of said second rod;

d) a chain depending from said cross member about halfway between said first rod and said second rod; and e) wherein said chain is attachable to the post and wherein said first and second hydraulic cylinder rods may be extended simultaneously in order to pull the post vertically from the ground.

2. The post puller according to claim 1, wherein said base further comprises a crossbeam joining said first leg and said second leg in parallel spaced relation.

3. The post puller according to claim 2, wherein said base is cast in one piece.

4. The post puller according to claim 2, wherein said crossbeam is normal to said first leg and said second leg and wherein said crossbeam is offset from a midpoint of said first leg and said second leg, said base defining a deep channel and a shallow channel.

5. The post puller according to claim 4, wherein said base further comprises:

a) a first rectangular, box shaped platform joined to said base in the deep channel at the junction of said first leg and said crossbeam, said first hydraulic cylinder being mounted on the first platform;

b) a second rectangular, box shaped platform joined to said base in the deep channel at the junction of said second leg and said crossbeam, said second hydraulic cylinder being mounted on the second platform; and c) wherein said first and second platforms are spaced apart to define a recess, the post being positionable in said recess.

6. The post puller according to claim 1, wherein said first, and second hydraulic cylinders are single action hydraulic cylinders.

7. The post puller according to claim 1, wherein said cross member comprises:

a) a first elongated plate and a second elongated plate;

b) a plurality of fasteners joining said first plate to said second plate; and c) a plurality of spacer sleeves disposed about said fasteners in order to maintain said first and second plates in parallel, spaced apart relation.

8. The post puller according to claim 7, wherein said plurality of fasteners includes a center fastener disposed midway between the free end of said first rod and the free end of said second rod, said chain being attached to said center fastener.

9. The post puller according to claim 1, further comprising post attachment means for attaching said chain to the post.

10. The post puller according to claim 9, wherein said post attachment means comprises a hook.

11. The post puller according to claim 9, wherein said post attachment means comprises a clamp.

12. The post puller according to claim 1, further comprising a plurality of wheels attached to said base for transporting the post puller.

13. The post puller according to claim 12, wherein said wheels are mounted at a rear of said base and elevated so that said wheels are raised above ground level when said legs are flush against the ground and so that said wheels engage the ground when the post puller is tilted to raise the legs above the ground.

14. A post puller for pulling a ground-mounted post, comprising:

a) a ground engaging base having two elongated legs and a crossbeam normal to the legs defining an H-shaped base, the crossbeam being offset from the midpoint of the two legs to define a deep channel and a shallow channel;

b) a first platform joined to one of said legs and the crossbeam in the deep channel, and a second platform joined to the other said leg and the crossbeam in the deep channel, the first and second platforms defining a recess for straddling a post;

c) a first single action hydraulic cylinder mounted on said first platform, the cylinder having a rod extendable from the cylinder and a pump handle attached to the cylinder for actuating the cylinder to extend and retract the rod;

d) a second single action hydraulic cylinder mounted on said second platform, the cylinder having a rod extendable from the cylinder and a pump handle attached to the cylinder for actuating the cylinder to extend and retract the rod;

e) an elongated cross member having a first end pivotally attached to the rod of said first hydraulic cylinder and a second end pivotally attached to said second rod, the cross member having a center;

f) a link chain attached to the center of said cross member, the chain being aligned vertically above the recess defined by said platforms, the chain being attachable to the post; and g) wherein said first and second hydraulic cylinders may be actuated sequentially to rock the post from side to side and to adjust for sloping ground, and wherein said cylinders may be actuated simultaneously to pull the post from the ground without lateral movement of the post.

15. The post puller according to claim 14, wherein said base is cast in one piece.

16. The post puller according to claim 14, wherein said base is made from a lightweight aluminum alloy.

17. The post puller according to claim 14, wherein said base and said first and second platforms are cast as a one piece unit.

18. The post puller according to claim 14, further comprising a pair of wheels mounted on said base, said wheels being mounted at an elevation above ground level when said base is engaging the ground, and said wheels engaging the ground for transporting the post puller when said post puller is tilted to raise said base off the ground.

19. The post puller according to claim 18, further comprising a pair of angle shaped brackets attached to said legs, each bracket having an axle mounted thereon, said wheels being rotatably mounted on said axles.

20. The post puller according to claim 14, further comprising post attachment means for attaching said chain to a post.

* * * * *